US007097068B2

(12) United States Patent
Limback et al.

(10) Patent No.: US 7,097,068 B2
(45) Date of Patent: Aug. 29, 2006

(54) TABLET DISPENSER WITH ISOLATED DELIVERY SENSOR

(75) Inventors: Scott R. Limback, Saint Paul, MN (US); Louis M. Holzman, Saint Paul, MN (US)

(73) Assignee: Ecolab Inc., St. Paul, MN (US)

( * ) Notice: Subject to any disclaimer, the term of this patent is extended or adjusted under 35 U.S.C. 154(b) by 172 days.

(21) Appl. No.: 10/863,663

(22) Filed: Jun. 8, 2004

(65) Prior Publication Data

US 2005/0269348 A1 Dec. 8, 2005

(51) Int. Cl.
*G07F 11/00* (2006.01)

(52) U.S. Cl. ..... 221/2; 221/227; 221/7; 221/258

(58) Field of Classification Search ..... 221/2, 221/155, 258, 277, 7, 265, 52, 263; 15/3.5, 15/74; 134/93, 56 D, 57 D, 58 D; 222/52, 222/129, 651; 422/266; 68/17 A
See application file for complete search history.

(56) References Cited

U.S. PATENT DOCUMENTS 2,333,791 A 11/1943 Hutchinson, Jr.
3,178,915 A * 4/1965 Wilhelm ..... 68/17 R
3,412,254 A 11/1968 Meyer-Doering et al.
3,527,383 A 9/1970 Borsum et al.
3,760,166 A 9/1973 Adams et al.
4,046,966 A 9/1977 Urui
4,129,230 A * 12/1978 Billett et al. ..... 221/268
4,396,828 A 8/1983 Dino et al.
4,573,606 A 3/1986 Lewis et al.
4,597,091 A 6/1986 Blake
4,980,292 A 12/1990 Elbert et al.
5,262,132 A * 11/1993 Bricker et al. ..... 422/263
5,638,417 A 6/1997 Boyer et al.
5,671,262 A 9/1997 Boyer et al.
5,768,327 A * 6/1998 Pinto et al. ..... 377/10
5,870,906 A * 2/1999 Denisar ..... 68/17 R
6,286,714 B1 * 9/2001 Pearson et al. ..... 221/164

FOREIGN PATENT DOCUMENTS

EP 1 159 913 A1 12/2001
WO PCT/WO94/27489 12/1994

OTHER PUBLICATIONS

OSMONICS, Inc., AUTOTROL® Brand Chlorination Equipment, Optional Accessories Brochure, Jan. 20, 2001, Minnetonka, Minnesota.

(Continued)

*Primary Examiner*—Gene O. Crawford
*Assistant Examiner*—Timothy Waggoner
(74) *Attorney, Agent, or Firm*—IPLM Group, P.A.

(57) ABSTRACT

A preferred embodiment proof of delivery system for use with a solid product dispenser includes an outlet conduit and a sensor mechanism. The outlet conduit is light transmissive and includes an interior surface and an exterior surface. The interior surface is exposed to humid conditions. The sensor mechanism is proximate the exterior surface of the outlet conduit, and the sensor mechanism senses delivery of a solid product through the outlet conduit. The outlet conduit provides a barrier to the humid conditions thereby protecting the sensor mechanism from exposure to the humid conditions.

21 Claims, 13 Drawing Sheets

OTHER PUBLICATIONS

Photo 1(a), perspective view of AUTOTROL® Chlorinator by OSMONICS, Inc. of Minnetonka, Minnesota, Jan. 20, 2001.
Photo 2(b), top view of AUTOTROL® Chlorinator by OSMONICS, Inc. of Minnetonka, Minnesota, Jan. 20, 2001.
Med Associates Inc., BIO-SERV® Pellet Dispenser & Pellet Receptacle, 1995, St. Albans, Vermont.
Photo 2(a), front perspective view of BIO-SERV® Pellet Dispenser by Med Associates Inc. of St. Albans, Vermont, 1995.
Photo 2(b), top view of BIO-SERV® Pellet Dispenser by Med Associates Inc. of St. Albans, Vermont, 1995.
Photo 2(c), side view of the metering and dispensing portion of BIO-SERV® Pellet Dispenser by Med Associates Inc. of St. Albans, Vermont, 1995.
Photo 2(d), side view of the metering and dispensing portion of BIO-SERV® Pellet Dispenser by Med Associates Inc. of St. Albans, Vermont, 1995.

* cited by examiner

TABLET DISPENSER WITH ISOLATED DELIVERY SENSOR

BACKGROUND OF THE INVENTION

1. Field of the Invention

The present invention relates to a product tablet dispenser with an isolated delivery sensor.

2. Description of the Prior Art

Solid product compositions in tablet form are typically used because they are relatively easy to formulate and dispense in a desired dosage. Such product tablets may be used for a variety of products including detergents, sanitizers, rinse aids, fabric softeners, bleaches, optical brightening chemicals, starching chemicals, and cleaners and sanitizers in general. However, depending upon the type of product, the product tablets may be caustic, messy, or otherwise difficult to handle and/or susceptible to environmental conditions such as humidity or other chemicals that can cause the product to clump or dissolve and disrupt the dispensing of the product.

Dispensers are typically used to dispense product tablets. The use of dispensers reduces the handling of the product tablets and allows for easy dispensing of the product in the desired dosage. For dispensers including hoppers containing a plurality of product tablets, the prior art dispensers are typically not effective in reducing exposure of the product tablets to the environmental conditions in which the product tablets are dispensed. As a result of being exposed to the environmental conditions, the product tablets may clump or dissolve thereby clogging the dispenser. If the dispenser becomes clogged, the dispenser will not dispense the product tablets properly.

Prior art dispensers also include outlets with various types of sensors. One type of outlet that has been used includes a tube with two small holes on opposite sides of the tube, and a beam of light is emitted and received through the holes in the tube. As a product tablet is dispensed through the outlet, the product tablet momentarily interrupts the reception of the beam of light, and the sensor provides a signal pulse indicating that the product tablet has been dispensed. A drawback to this configuration is that it can result in blockage of the holes through which the beam of light passes thereby disabling the operation of the sensor. For example, the holes could be blocked by powder or small particles of the product tablets being dispensed, condensation, residual product, and other residue such as from evaporation of chemical laden moisture from the dishwashing machine.

It is desired to provide a tablet dispenser that will protect the product tablets from exposure to various environmental conditions such as moisture and chemicals during use of a dishwashing machine and to prevent interference with the operation of the sensors.

SUMMARY OF THE INVENTION

A preferred embodiment proof of delivery system for use with a solid product dispenser includes an outlet conduit and a sensor mechanism. The outlet conduit is light transmissive and includes an interior surface and an exterior surface. The interior surface is exposed to humid conditions. The sensor mechanism is proximate the exterior surface of the outlet conduit, and the sensor mechanism senses delivery of a solid product through the outlet conduit. The outlet conduit provides a barrier to the humid conditions thereby protecting the sensor mechanism from exposure to the humid conditions.

A preferred embodiment proof of delivery system for use with a solid product dispenser includes an outlet conduit and a light sensor mechanism. The outlet conduit is light transmissive. The light sensor mechanism includes an emitter emitting a beam and a receiver receiving the beam. The emitter is positioned on one side of the outlet conduit and the receiver is positioned on an opposite side of the outlet conduit. The emitter emits the beam and the receiver receives the beam through the outlet conduit. The outlet conduit protects the light sensor mechanism from contamination by residue within the outlet conduit.

A preferred embodiment proof of delivery system for use with a solid product tablet dispenser includes a product tablet, an outlet conduit through which the product tablet is dispensed, and an infrared sensor mechanism. The outlet conduit is light transmissive. The infrared sensor mechanism includes an emitter emitting a beam and a receiver receiving the beam. The emitter is positioned on one side of the outlet conduit and the receiver is positioned on an opposite side of the outlet conduit. The emitter emits the beam and the receiver receives the beam through the outlet conduit. The outlet conduit protects the infrared sensor mechanism from contamination by residue within the outlet conduit, wherein as the product tablet is dispensed through the outlet conduit, the product tablet interrupts the beam within the outlet conduit, and the infrared sensor mechanism provides indication that the product tablet has been dispensed.

DETAILED DESCRIPTION OF A PREFERRED EMBODIMENT

Figure 1:
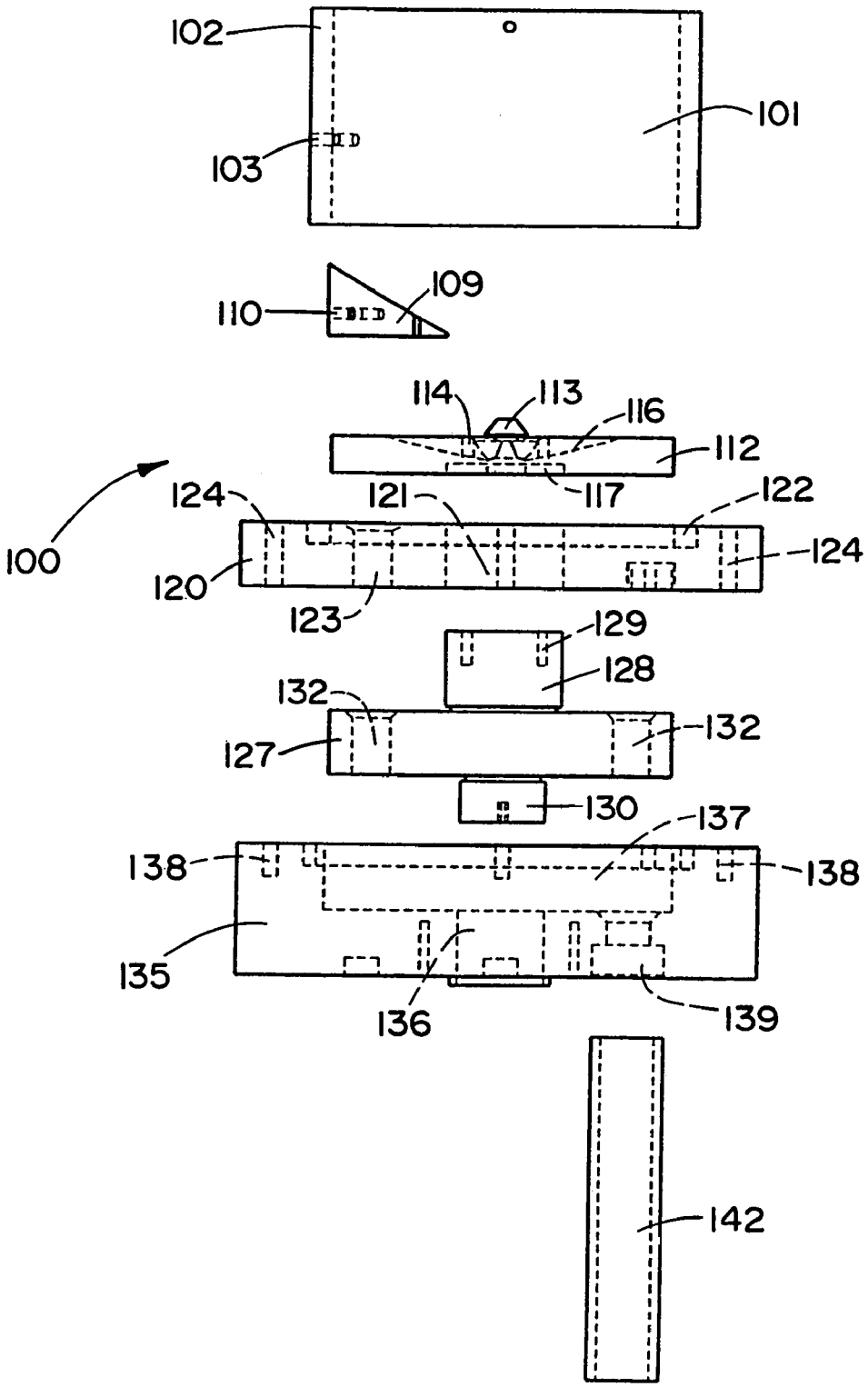
FIG. 1 is an exploded side view of a tablet dispenser constructed according to the principles of the present invention.

A preferred embodiment tablet dispenser constructed according to the principles of the present invention is designated by the numeral 100 in the drawings.

The preferred embodiment tablet dispenser 100 is preferably mounted to the top of the dishwashing machine and used to dispense a product such as a sanitizer in tablet form into a dishwashing machine (not shown) with proof of delivery to the user. The tablet dispenser 100 ensures that the use solution including the sanitizer is in the desired range of 50 to 100 ppm after the product tablet is dissolved. Because the environment in which the product tablet is dispensed includes moisture and vapor, it is desirable to isolate the product tablets within the tablet dispenser 100 from the humid environment within the dishwashing machine. It is recognized that the tablet dispenser 100 may be used to dispense many different types of products for use in many different types of applications and is not limited to the products and the applications described herein. For example, the present invention could also be used for detergents, rinse aids, fabric softeners, bleaches, optical brightening chemicals, starching chemicals, manual dishwashing products, cleaning products used in spray bottles or mop buckets, laundry products, animal feed supplements, and other suitable products. Further, the term "tablets" is used throughout, and it is understood that the term "tablets" includes product in the form of tablets, pellets, granules, or other suitable forms well known in the art.

The tablet dispenser 100 includes a hopper 101, a dispensing mechanism including disk members creating an interrupted flow path through which product tablets 168 are dispensed, a motor or gear head 172 to drive the disk members, an outlet conduit 142, and a sensor mechanism 155 to provide indication of proof of delivery of the product tablets 168.

Figure 2:
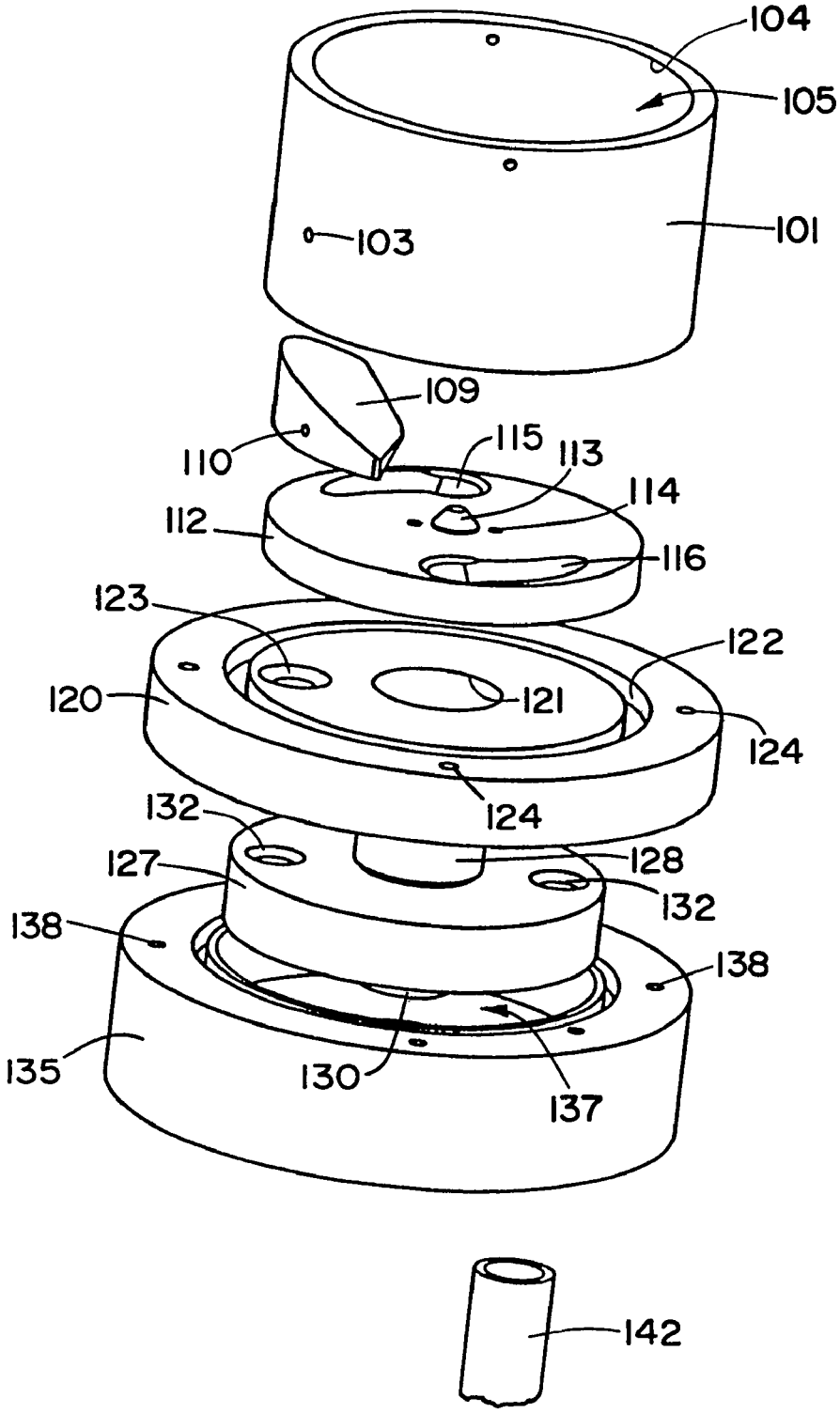
FIG. 2 is an exploded top perspective view of the tablet dispenser shown in FIG. 1.
Figure 3:
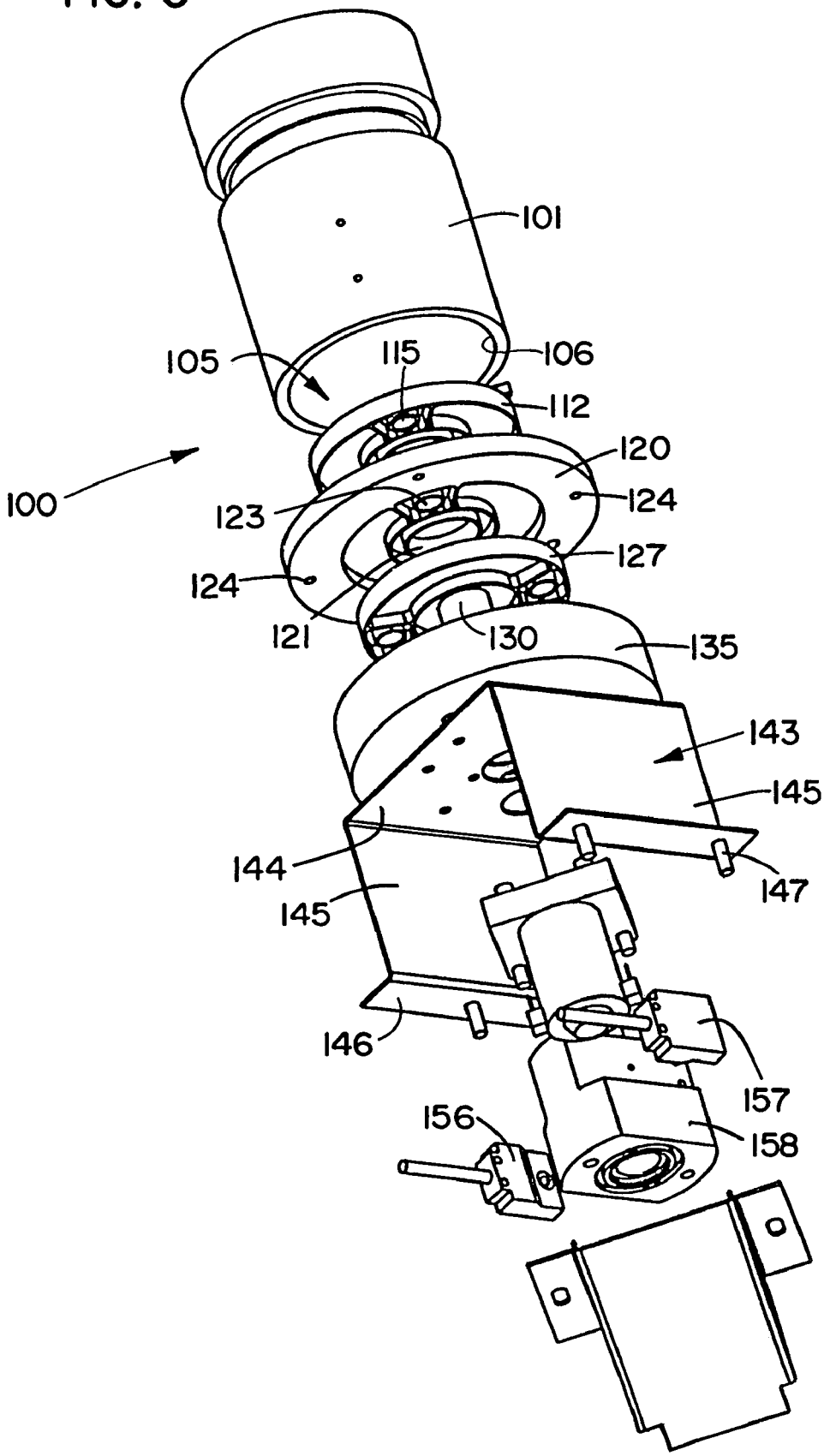
FIG. 3 is an exploded bottom perspective view of the tablet dispenser shown in FIG. 1.

As shown in FIGS. 1–3, the hopper 101 includes a side wall 102, which is preferably a hollow cylindrical housing with a top opening 104, a bottom opening 106, and a cavity 105 configured and arranged to contain the plurality of product tablets 168. The hopper 101 is used to store the product tablets 168 and is preferably located above the disk members. A wiper 109 may be operatively connected to the side wall 102 of the hopper 101 proximate the bottom of the hopper 101. The wiper 109 is preferably a wedge shaped member. A fastener (not shown) may be inserted through an aperture 103 in the side wall 102 and an aperture 110 in the wiper 109 to operatively connect the wiper 109 to the hopper 101.

The first disk member 112 preferably has a diameter slightly smaller than the inside diameter of the bottom of the hopper 101 so that the first disk member 112 fits within the cavity 105 proximate the bottom of the hopper 101. A hub 113 is operatively connected to the top of the first disk member 112 proximate the center thereof, and the hub is preferably frustoconical shaped to guide the product tablets 168 away from the center of the first disk member 112 to assist in minimizing the number of un-dispensed product tablets 168. Apertures 114 extend longitudinally through the first disk member 112 on opposing sides of the hub 113 proximate the center of the first disk member 112, and dispensing apertures 115 extend longitudinally through the first disk member 112 on opposing sides of the hub 113 proximate the edge of the first disk member 112.

Preferably, the dispensing apertures 115 are placed 90 degrees from the apertures 114. Although the dispensing apertures 115 preferably each contain one whole product tablet 168, it is recognized that the product tablets 168 may become broken so the dispensing apertures 115 are configured and arranged to contain the equivalent of one to two product tablets 168, broken and/or whole. Therefore, the term "product tablet" or "product tablets" used throughout includes whole tablets and/or portions of whole tablets. Although two dispensing apertures 115 are shown, it is recognized that one or more dispensing apertures may be used. Further, the top of the first disk member 112 may also include dispensing ramps 116, which are declining, sloped grooves approaching the dispensing apertures 115. The bottom of the first disk member 112 includes a recess 117 proximate the center of the first disk member 112 below the hub 113.

The second disk member 120 preferably has a diameter greater than the diameter of the bottom of the hopper 101 and includes a groove 122 into which the bottom of the side wall 102 of the hopper 101 is placed to operatively connect the hopper 101 to the second disk member 120. The second disk member 120 and the hopper 101 are preferably stationary. A bore 121 extends longitudinally through the center of the second disk member 120, and a dispensing aperture 123 extends longitudinally through the second disk member 120 between the bore 121 and the groove 122, more proximate the groove 122, so that the dispensing aperture 123 intermittently aligns with the dispensing apertures 115 of the first disk member 112. The second disk member 120 also includes apertures 124 between the groove 122 and the edge of the second disk member 120. There are preferably four apertures 124 approximately 90 degrees apart from one another.

Figure 6:
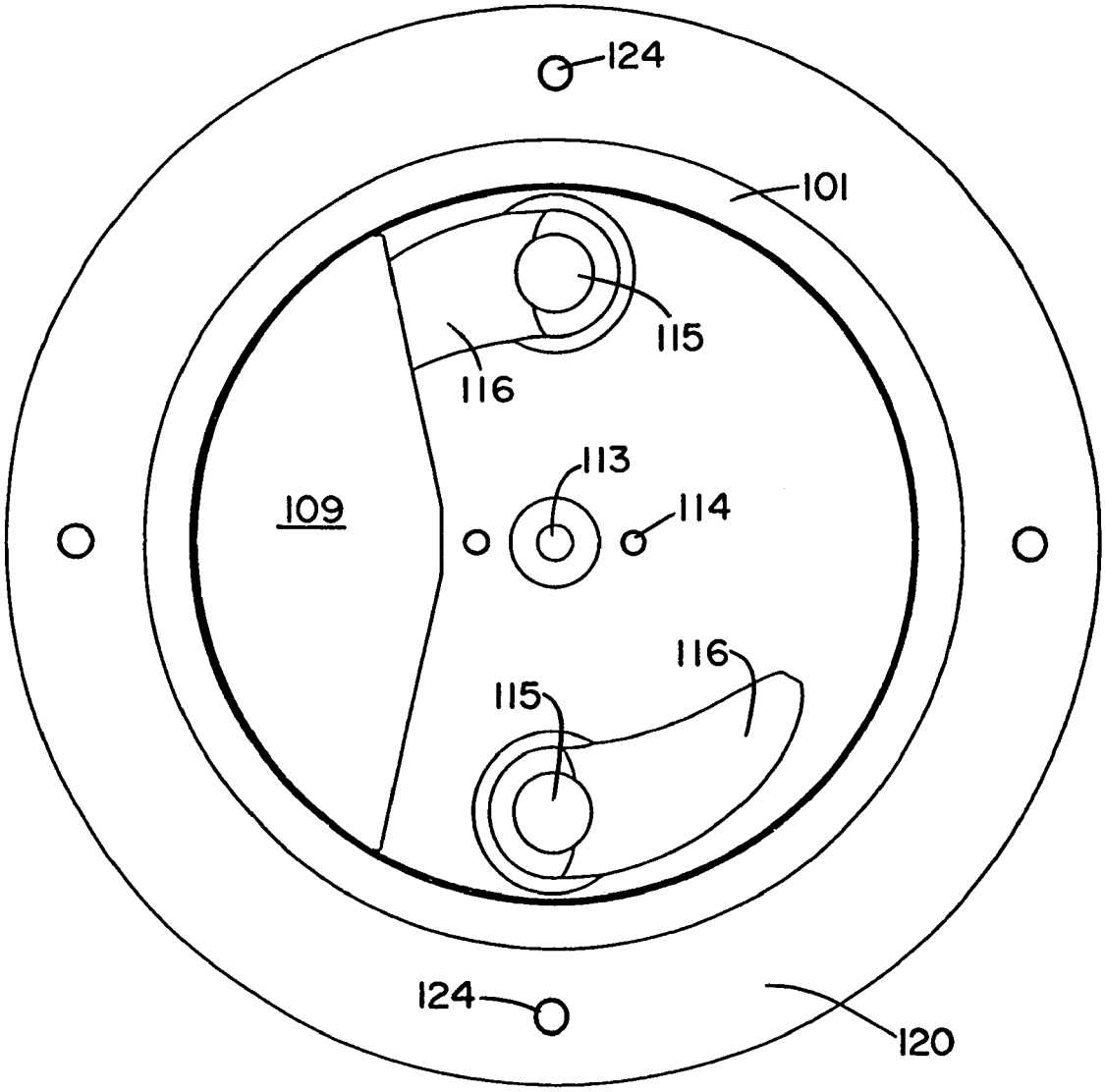
FIG. 6 is a top view of the tablet dispenser shown in FIG. 1 including a first disk member having a first dispensing aperture in a first position.
Figure 7:
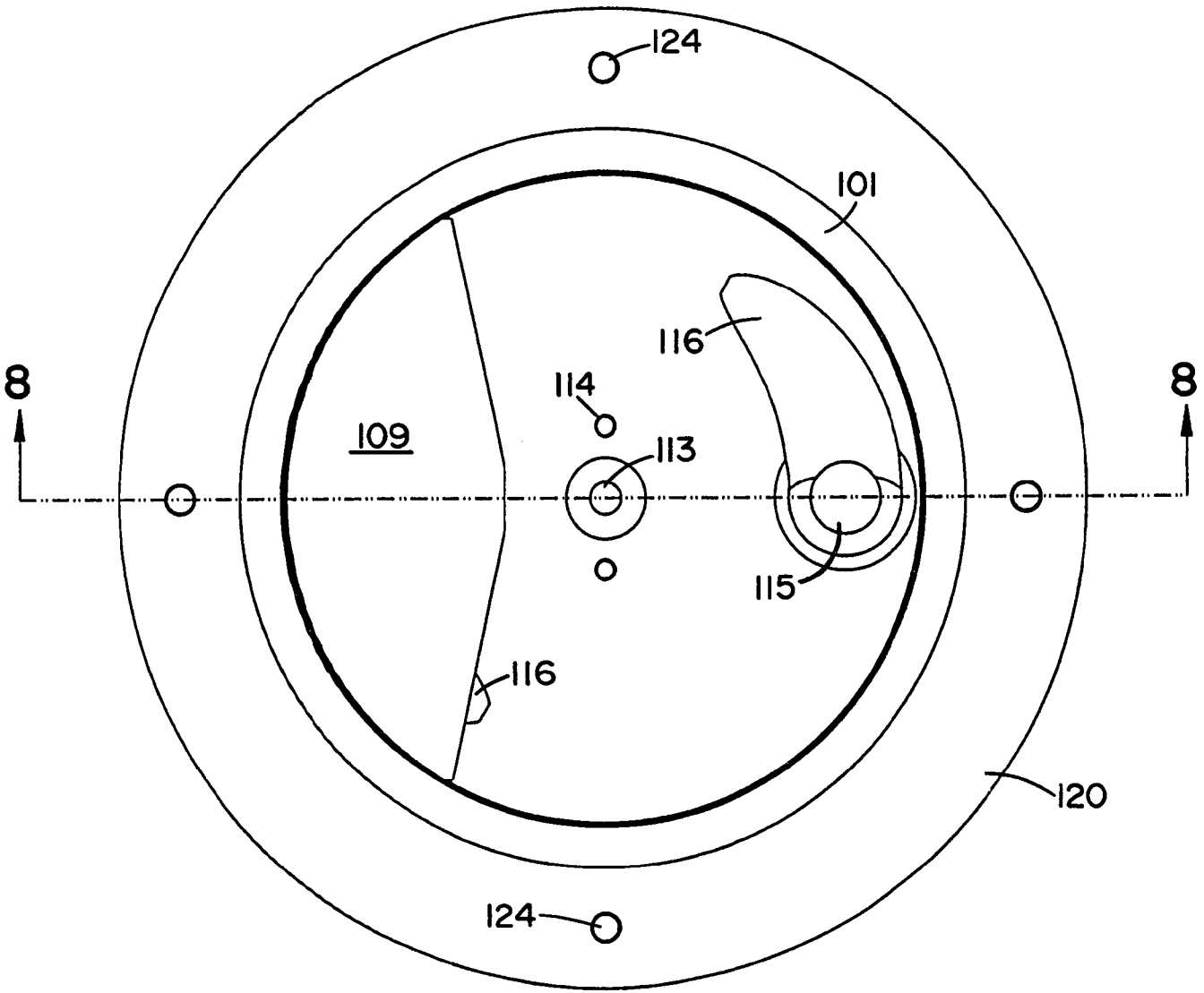
FIG. 7 is another top view of the tablet dispenser shown in FIG. 1 including the first disk member having the first dispensing aperture shown in FIG. 6 in a second position.

The wiper 109 mounted to the hopper 101 is also stationary and is preferably positioned proximate the first disk member 112 and aligned with the dispensing aperture 123. As shown in FIGS. 6 and 7, the wiper 109 preferably does not contact the hub 113, which guides the product tablets 168 away from the center of the first disk member 112 to assist in minimizing the number of un-dispensed product tablets 168. As the first disk member 112 is rotated so that one of the dispensing apertures 115 aligns with the dispensing aperture 123 of the second disk member 120, the wiper 109 diverts extraneous product tablets 168 that do not fit within the approaching dispensing aperture 115 away from the dispensing aperture 115 as the dispensing aperture 115 rotates past the wiper 109. The dispensing aperture 115 is configured and arranged to contain a predetermined quantity of product tablets. In other words, the wiper 109 removes excess product tablets 168 proximate the dispensing aperture 115 as the dispensing aperture 115 is rotated proximate the dispensing aperture 123 thereby ensuring a desired number of product tablets 168 is transferred from the dispensing aperture 115 to the dispensing aperture 123 as the first disk member 112 is rotated to align the dispensing aperture 115 with the dispensing aperture 123. The wiper 109 ensures that only the desired dosage is dispensed each time one of the dispensing apertures 115 aligns with the dispensing aperture 123. Further, the ramp 116 assists in easing the extraneous product tablets 168 away from the dispensing aperture 115 and because the ramp 116 is gradual, the product tablets 168 do not get caught on an edge of the dispensing aperture 115 or crushed between the wiper 109 and the dispensing aperture 115 thereby causing the product tablets 168 to break. The wiper 109 eases excess product tablets 168 away from the dispensing aperture 115 along the ramp 116, which reduces the occurrence of breakage of the excess product tablets 168.

The third disk member 127 includes an upper boss 128 extending upward from the top proximate the center of the third disk member 127 and a lower boss 130 extending downward from the bottom proximate the center of the third disk member 127. The upper boss 128 is configured and arranged to extend through the bore 121 of the second disk member 120 and into the recess 117 of the first disk member 112. The upper boss 128 includes apertures 129 that align with apertures 114, and a fastener (not shown) is inserted into the apertures 129 and 114 to interconnect the third disk member 127 and the first disk member 112, which are preferably concurrently rotatable while the second disk member 120 is stationary. The lower boss 130 includes a notch 131 into which a coupling of a shaft of a motor 172 is inserted and operatively connected to the third disk member 127 to rotate the third disk member 127 and the first disk member 112. The third disk member 127 includes preferably two opposing dispensing apertures 132, which are preferably 90 degrees from the dispensing apertures 115 of the first disk member 112, and are intermittently aligned with the dispensing aperture 123.

Although two dispensing apertures 132 are shown, it is recognized that one or more dispensing apertures may be used. The first disk member 112 and the third disk member 127 are preferably concurrently rotated so that when the dispensing aperture 115 is aligned with the dispensing aperture 123, the dispensing aperture 132 is approximately 90 degrees behind the dispensing apertures 115 and 123 and when the dispensing aperture 132 is aligned with the dispensing aperture 123, the dispensing aperture 115 is approximately 90 degrees ahead of the dispensing apertures 123 and 132. Therefore, the dispensing apertures 115 and 132 are preferably approximately 90 degrees apart with respect to the dispensing aperture 123. It is recognized that as long as the dispensing apertures 115 and 132 do not align with the dispensing aperture 123 at substantially the same time, any number of degrees of separation is acceptable as long as there is not a direct flow path with at least a portion of the dispensing apertures 115, 123, and 132.

The fourth disk member 135, which is optional, is preferably stationary and used to connect the outlet conduit 142 to the tablet dispenser 100. The fourth disk member 135 includes a bore 136 extending longitudinally through the center of the fourth disk member 135 and a recess 137 in the top of the fourth disk member 135 proximate the center of the fourth disk member 135. The recess 137 is configured and arranged to house the third disk member 127, with the lower boss 130 extending into the bore 136. The motor 172 extends into the bore 136 and is operatively connected to the lower boss 130. Apertures 138 align with apertures 124 of the second disk member 120 and fasteners (not shown) are inserted into the apertures 138 and 124 to interconnect the fourth disk member 127 and the second disk member 120. The fourth disk member 135 also includes a dispensing aperture 139 to which the outlet conduit 142 is operatively connected, and the dispensing aperture 139 is intermittently aligned with the dispensing apertures 132 of the third disk member 127. The dispensing aperture 139 is preferably located approximately 180 degrees from the dispensing aperture 123 thereby further isolating the hopper 101 from the outlet conduit 142. When the dispensing apertures 139 and 132 align, the product tablets 168 are dispensed from the dispensing aperture 132 to the dispensing aperture 139 and then through the outlet conduit 142.

The outlet conduit 142 is preferably light transmissive meaning transparent and/or translucent. The outlet conduit 142 is preferably tubular having an interior surface and an exterior surface. The interior surface is exposed to the humid conditions of the dishwashing machine and the wall of the outlet conduit 142 acts as a barrier protecting the exterior surface from exposure to the humid conditions.

The disk members execute the dispensing of the product tablets 168 through the respective dispensing apertures in an interrupted flow path to isolate the product tablets 168 within the hopper 101 from moisture and vapor generated by the dishwashing machine. The flow path is interrupted because as the disk members rotate there is not a continuous flow of the product tablets 168 from one dispensing aperture to the next dispensing aperture. The interrupted flow path "seals" the hopper 101 from the outside elements that have entered the outlet conduit 142. Although it is recognized that some moisture and vapor or other outside elements may enter the hopper 101, the disk members seal the hopper 101 in that the disk members help prevent and limit exposure of the product tablets 168 inside the hopper 101 to moisture and vapor or other outside elements. At least three disk members should be used to effectively isolate the hopper 101 from outside elements. Preferably, each dynamic (rotatable) disk member is positioned adjacent a static (stationary) disk member to isolate the hopper 101 from the humid environment of the dishwashing machine.

Preferably, the thickness of the first disk member 112 and the diameter of the dispensing aperture 115 are configured and arranged to contain a predetermined quantity of product tablets 168 thereby ensuring that the desired dosage is dispensed. In other words, the diameter and the height of the dispensing aperture 115 define a volume in which the product tablets 168 are contained thereby selecting the dose of product tablets 168. The subsequent disk members are preferably thicker than the first disk member 112 and each subsequent dispensing aperture in the flow path has a diameter that is preferably slightly larger than the previous dispensing aperture diameter. The thicker disk members and the increasingly larger dispensing aperture diameters assist in preventing jamming of the dispenser as the product tablets are dispensed because the volumes in which the product tablets are contained increase as they move through the flow path. In addition, it is also preferable that the diameters of the dispensing apertures are tapered or at least countersunk so that the top of each dispensing aperture is smaller than the bottom of each dispensing aperture.

Although the preferred embodiment includes at least one static disk member and at least two dynamic disk members to isolate the hopper 101 from the humid environment of the dishwashing machine, it is recognized that additional disk members could be used to further isolate the hopper. The dispensing apertures could be any size or shape to accommodate varying sizes and shapes of product tablets. In addition, seal rings could be machined or molded directly onto the disk members to create a seal between the disks. It is also recognized that O-rings could be used to seal each of the dispensing apertures of the disk members against the adjacent disk member.

Figure 4:
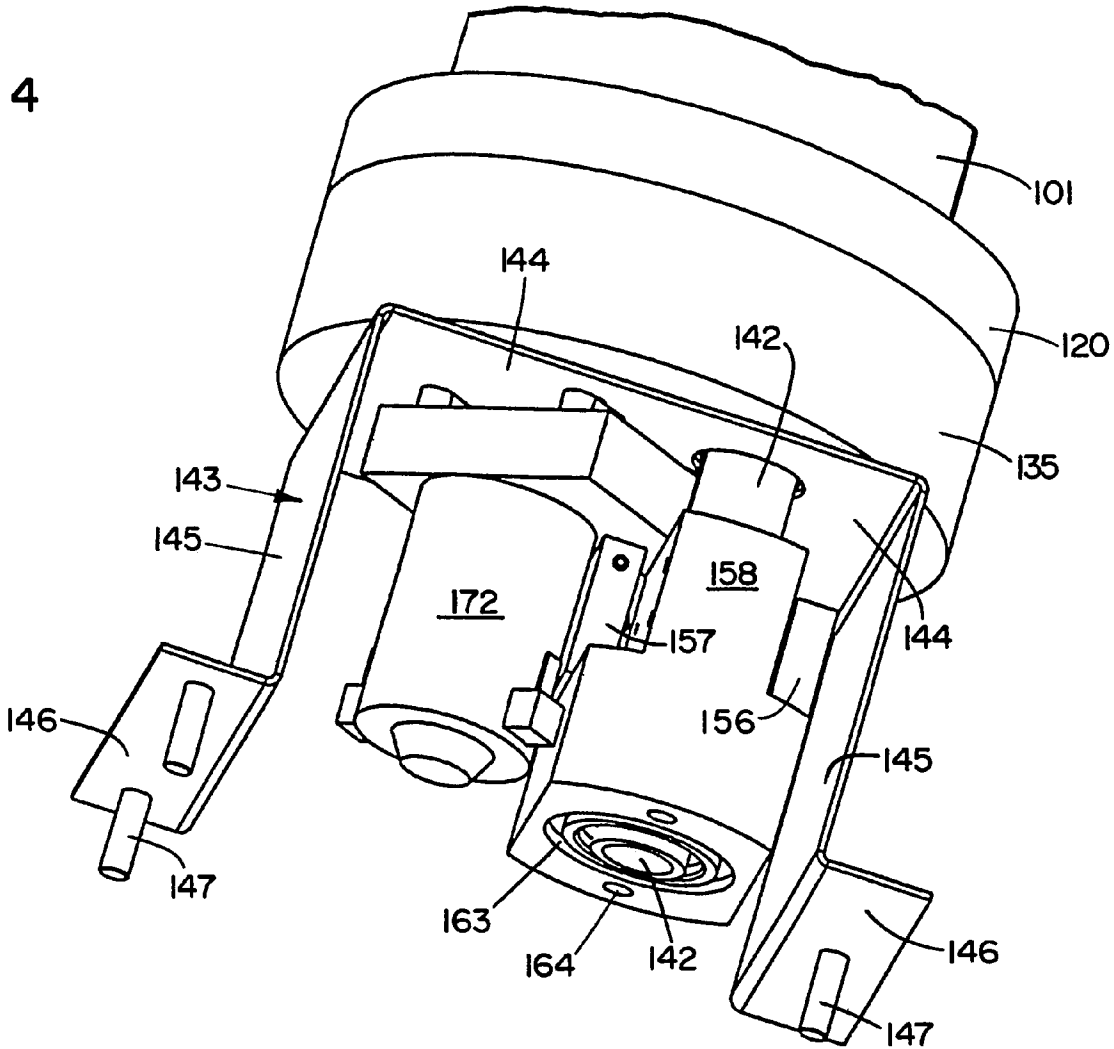
FIG. 4 is a partial bottom perspective view of the tablet dispenser shown in FIG. 1.

A frame 143, shown in FIG. 4, may be used to elevate the tablet dispenser 100 with respect to the mounting surface, such as a dishwashing machine, to accommodate the motor 172 and the sensor mechanism 155. The frame 143 is preferably an upside down U-shaped member having outward extending support members on each end. The frame 143 includes a top 144 with two sides 145 extending downward from two opposing sides of the top 144 and a flange 146 extending outward from each side 145. The top 144 supports the hopper 101 and the disk members, and the flanges 146 support the frame 143 on the mounting surface. Connectors 147 such as bolts or other suitable fasteners may be used to connect the flanges 146 of the frame 143 to the mounting surface.

Figure 5:
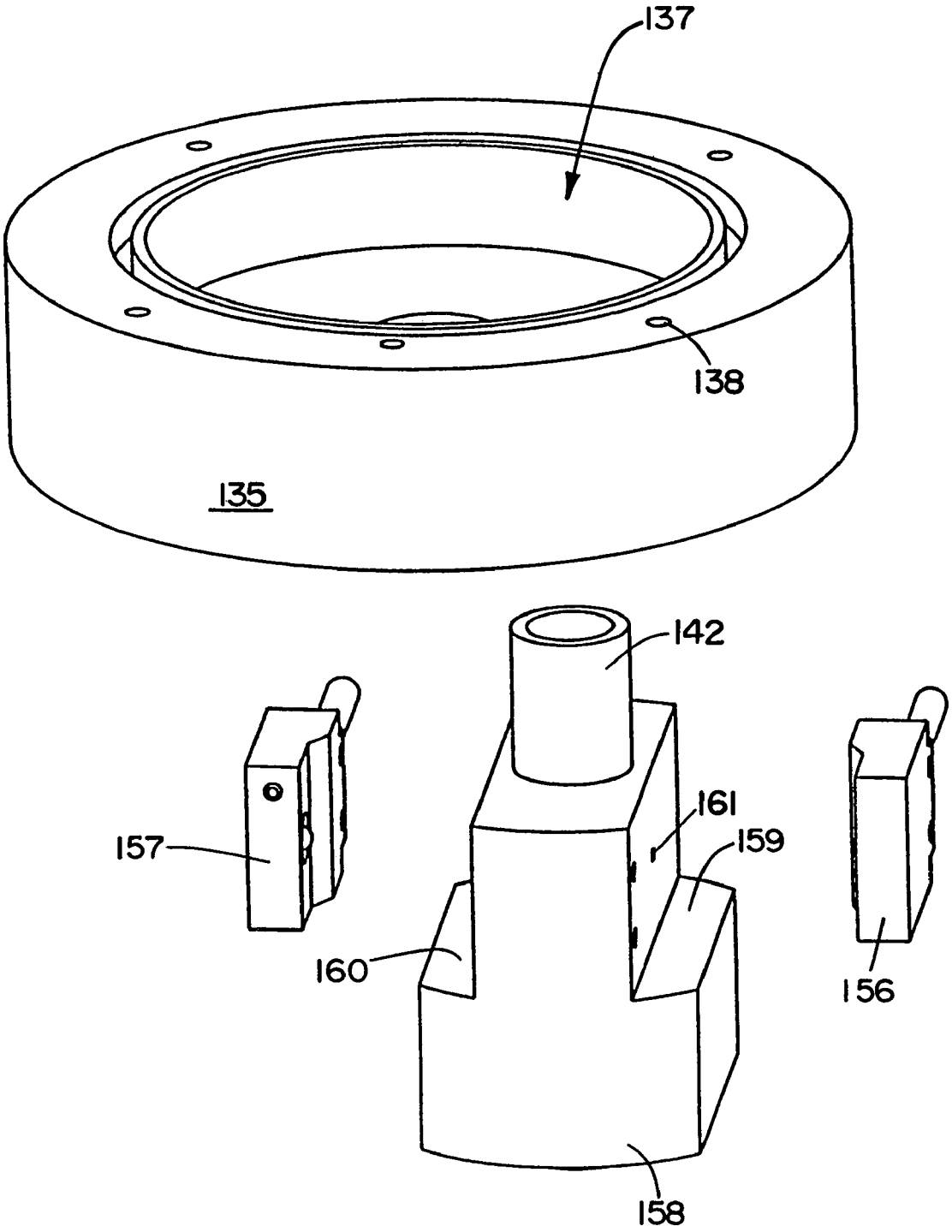
FIG. 5 is an exploded side perspective view of a sensor mechanism for use with the tablet dispenser shown in FIG. 1.
Figure 12:
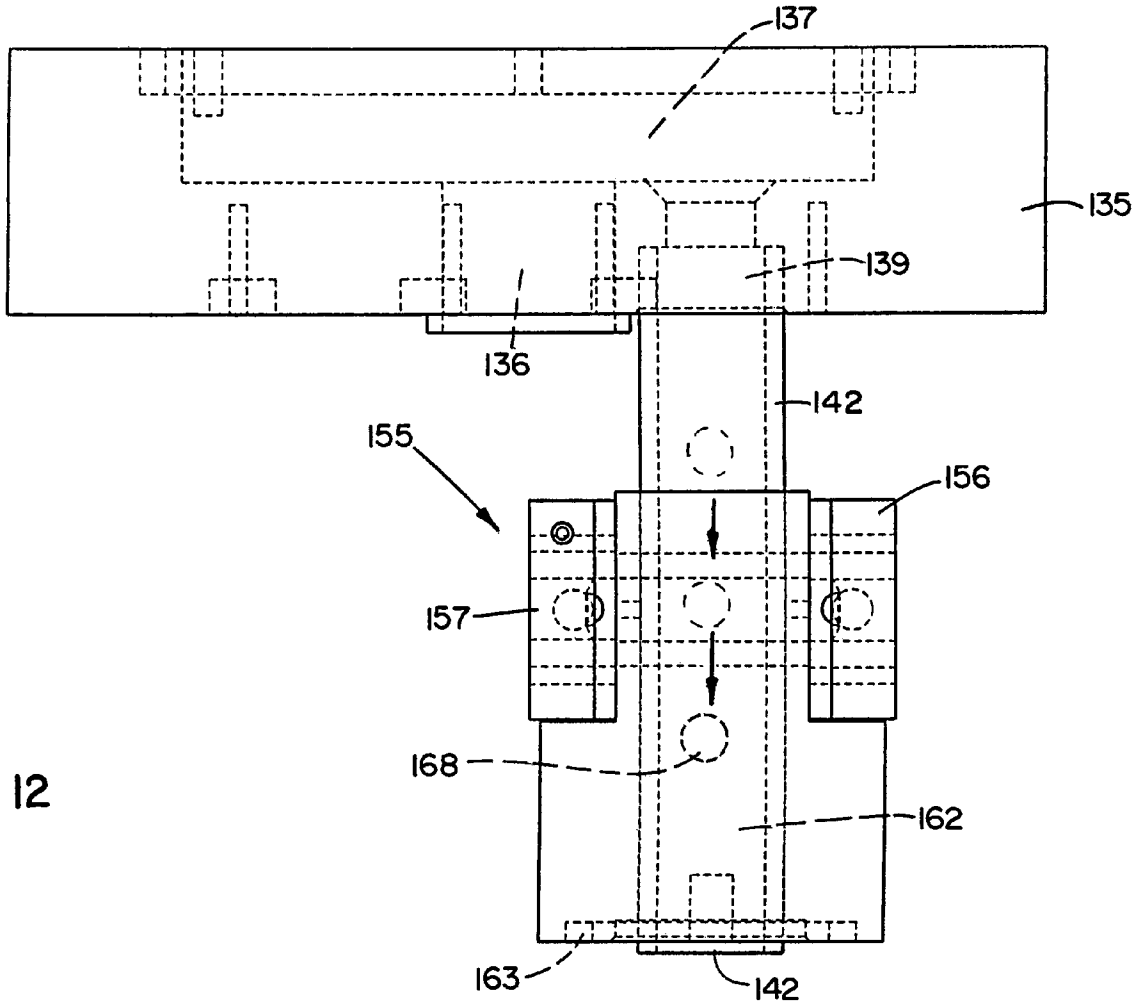
FIG. 12 is a side view of the sensor mechanism shown in FIG. 5 operatively connected to the tablet dispenser shown in FIG. 1.

The preferred sensor mechanism 155, shown in FIGS. 5 and 12, is an infrared light sensor including an emitter 156 and a receiver 157 operatively connected to a housing 158 proximate the outlet conduit 142 to provide indication of proof of delivery of the product tablets 168 into the dishwashing machine. The emitter 156 emits a light beam and the receiver 157 receives the light beam from the emitter 156. It is recognized that other suitable types of sensors could be used such as a capacitive sensor. A capacitive sensor does not require an optical transmission and includes two electrodes with a signal in between the two electrodes. The signal changes when an object is proximate the signal. The electrodes would be mounted outside the tubing, and the sensitivity of the signal would be adjusted to not sense the tubing.

The housing 158 is preferably an upside down T-shaped tubular member including a first ledge 159 for supporting the emitter 156, a second ledge 160 for supporting the receiver 157, and a bore 162 through which the outlet conduit 142 extends. The housing 158 also includes a lateral aperture 161 on each side of the housing 158, each lateral aperture 161 extending into the bore 162 to allow the beam of light being emitted from the emitter 156 and received by the receiver 157 to be transmitted through the housing and the outlet conduit 142. Fasteners (not shown) may be inserted into apertures 164 to secure and seal the housing 158 to the mounting surface such as a dishwashing machine. The bottom of the housing 158 may also include circular grooves 163 around the bore 162 for O-rings (not shown) to seal the housing 158, and therefore the outlet conduit 142, from humid conditions inside the dishwashing machine.

The outlet conduit 142 extends from the tablet dispenser 100 to the dishwashing machine, and the sensor mechanism 155 operates through the outlet conduit 142. The beam of light is emitted and received through the outlet conduit 142. Because the O-ring seals the outlet conduit 142 to the dishwashing machine, the moisture and vapors within the dishwashing machine do not escape proximate the outlet conduit 142 and the sensor mechanism 155 is protected from the humid conditions inside the dishwashing machine.

Some possible contaminants that may interfere with the operation of the sensor mechanism 155 include various types of residue such as condensation, portions of the product tablet(s), and residual product. In addition, among other possible contaminants that may interfere with the operation of the sensor mechanism 155, capillary action may cause the chemical laden moisture to seep up the outside of the outlet conduit 142 to the sensor mechanism 155 and eventually block the sensor mechanism 155. Sealing the outlet conduit 142 to the dishwashing machine helps prevent this from happening. Sealing the outlet conduit 142 to the housing 158 isolates the components of the sensor mechanism 155, including the emitter 156, the receiver 157, and the apertures 161 through which the beam of light passes. This isolation prevents the buildup of residual product and/or chemical exposure, which could obstruct the operation of the sensor mechanism 155.

The sensor mechanism 155 preferably has a relatively high speed response time, preferably a 1 ms response time. The inside diameter of the outlet conduit 142 should be small enough so that the product tablet 168 dispensed through the outlet conduit 142 will pass through the light beam transmitted through the outlet conduit 142 to interrupt the receipt of the light beam by the receiver 157. Preferably, the inside diameter of the outlet conduit 142 is slightly less than double the smallest product tablet dimension.

Figure 8:
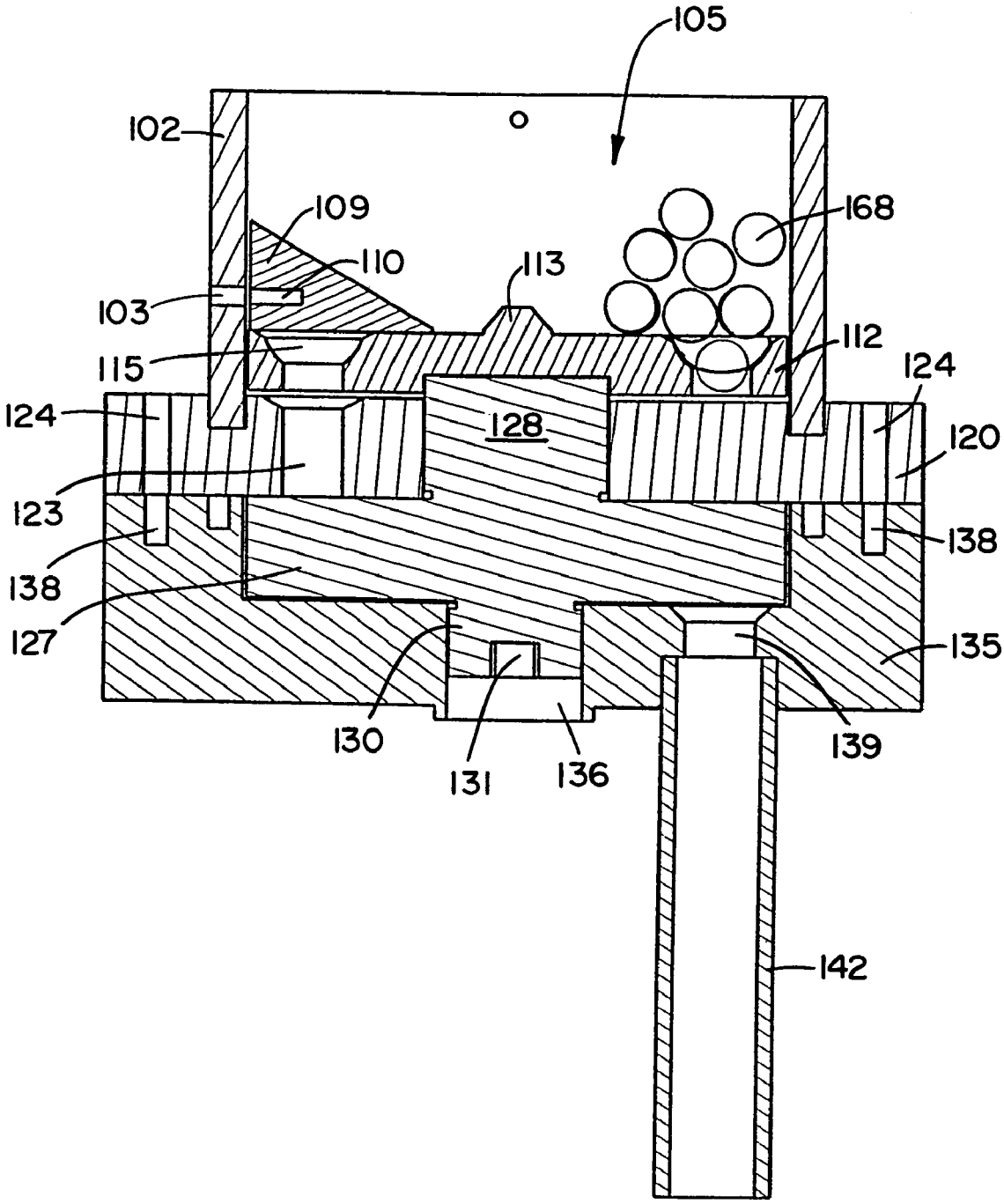
FIG. 8 is a side cross-sectional view of the tablet dispenser shown in FIG. 1 having a product tablet in the first dispensing aperture in the second position shown in FIG. 7.
Figure 9:
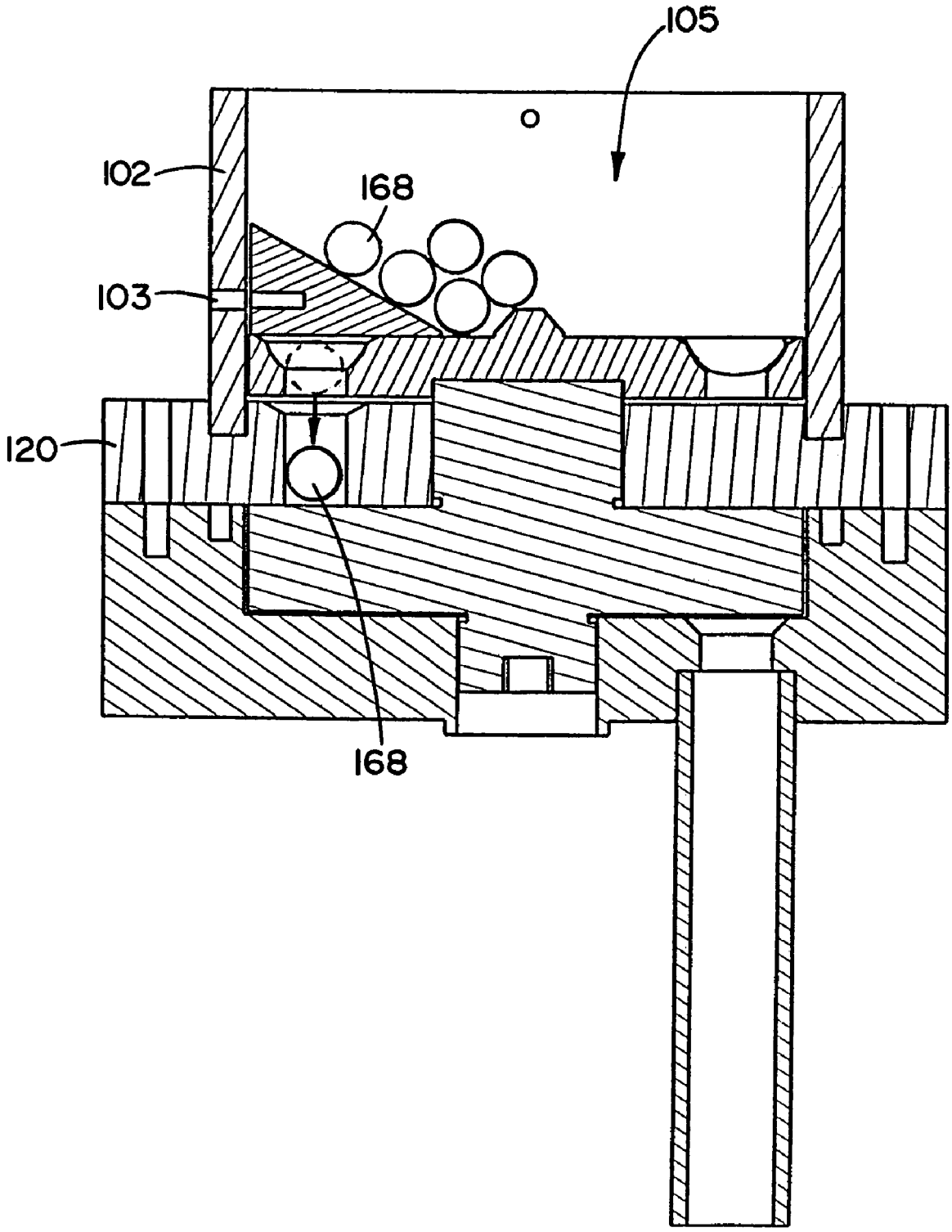
FIG. 9 is a side cross-sectional view of the tablet dispenser shown in FIG. 1 showing the product tablet being transferred from the first dispensing aperture rotated 180 degrees from the second position shown in FIGS. 7 and 8 to a second dispensing aperture in a second disk member.

In operation, a container of product tablets 168 is docked onto the hopper 101. A signal is provided to the tablet dispenser 100 to dispense product at the desired time. If the tablet dispenser 100 is used with a dishwashing machine to dispense a sanitizing product, the dishwashing machine will signal delivery of the product tablet 168 for the sanitizing rinse cycle of the dishwashing machine. Power is applied to the motor 172 or gear head to begin rotation of the dynamic disk members 112 and 127. Rotation of the disk member 112 assists in the first dispensing aperture 115 receiving a product tablet 168 within the hopper 101, as shown in FIG. 8. As the first disk member 112 rotates, the first dispensing aperture 115 of the first disk member 112 aligns with the second dispensing aperture 123 of the second disk member 120 and the product tablet 168 is transferred from the first dispensing aperture 115 to the second dispensing aperture 123, as shown in FIG. 9. The wiper 109 blocks additional product tablets 168 from entering the first dispensing aperture 115 when aligned with the second dispensing aperture 123.

Figure 10:
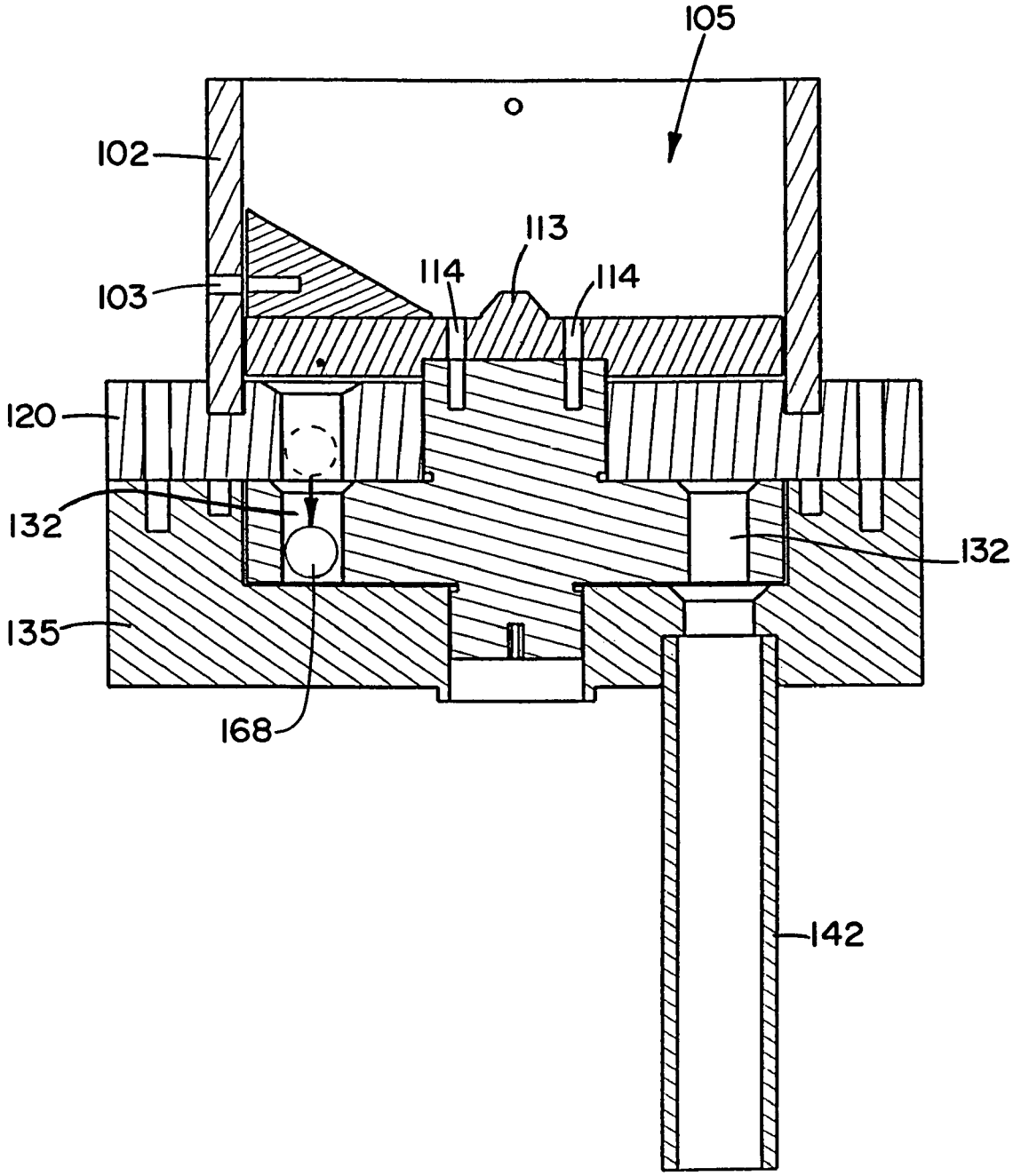
FIG. 10 is a side cross-sectional view of the tablet dispenser shown in FIG. 1 showing the product tablet being transferred from the second dispensing aperture shown in FIG. 9 to a third dispensing aperture in a third disk member.
Figure 11:
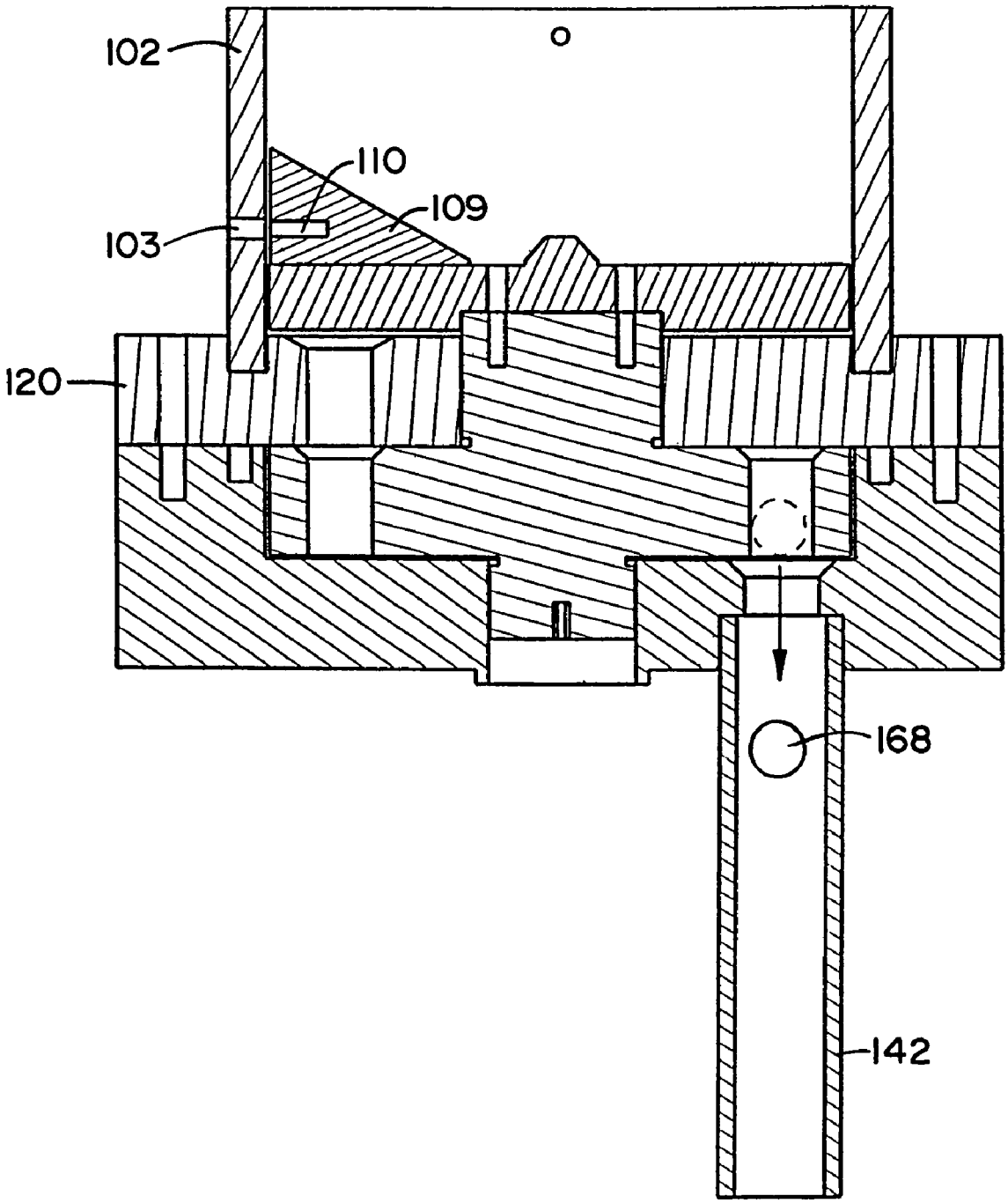
FIG. 11 is a side cross-sectional view of the tablet dispenser shown in FIG. 1 showing the product tablet being transferred from the third dispensing aperture rotated 180 degrees from the position shown in FIG. 10 to a fourth dispensing aperture in a fourth disk member and an outlet conduit.

As the third disk member 127 rotates, preferably concurrently with the first disk member 112, the third dispensing aperture 132 aligns with the second dispensing aperture 123 and the product tablet 168 is transferred from the second dispensing aperture 123 to the third dispensing aperture 132, as shown in FIG. 10. The third dispensing aperture 132 and the first dispensing aperture 115 are positioned at different locations with respect to the second dispensing aperture 123 thereby aligning with the second dispensing aperture 123 at separate times resulting in an interrupted flow path for the product tablets 168. As the third disk member 127 continues to rotate, the third dispensing aperture 132 aligns with the fourth dispensing aperture 139 of the fourth disk member 135 and the product tablet 168 is transferred from the third dispensing aperture 132 to the fourth dispensing aperture 139, as shown in FIG. 11. The fourth dispensing aperture 139 is in fluid communication with the outlet conduit 142, and the product tablet 168 is then dispensed through the outlet conduit 142 into the dishwashing machine.

As the product tablets 168 flow through the outlet conduit 142, as shown in FIG. 12, the sensor mechanism 155 detects the delivery of the product tablet 168 into the dishwashing machine. When the delivery is sensed, the motor 172 or gear head is stopped and a delivery message is displayed. If no product tablet 168 is sensed within a specified time period, the motor 172 is stopped and an out of product message is displayed indicating that another container of product tablets 168 needs to be installed.

Figure 13:
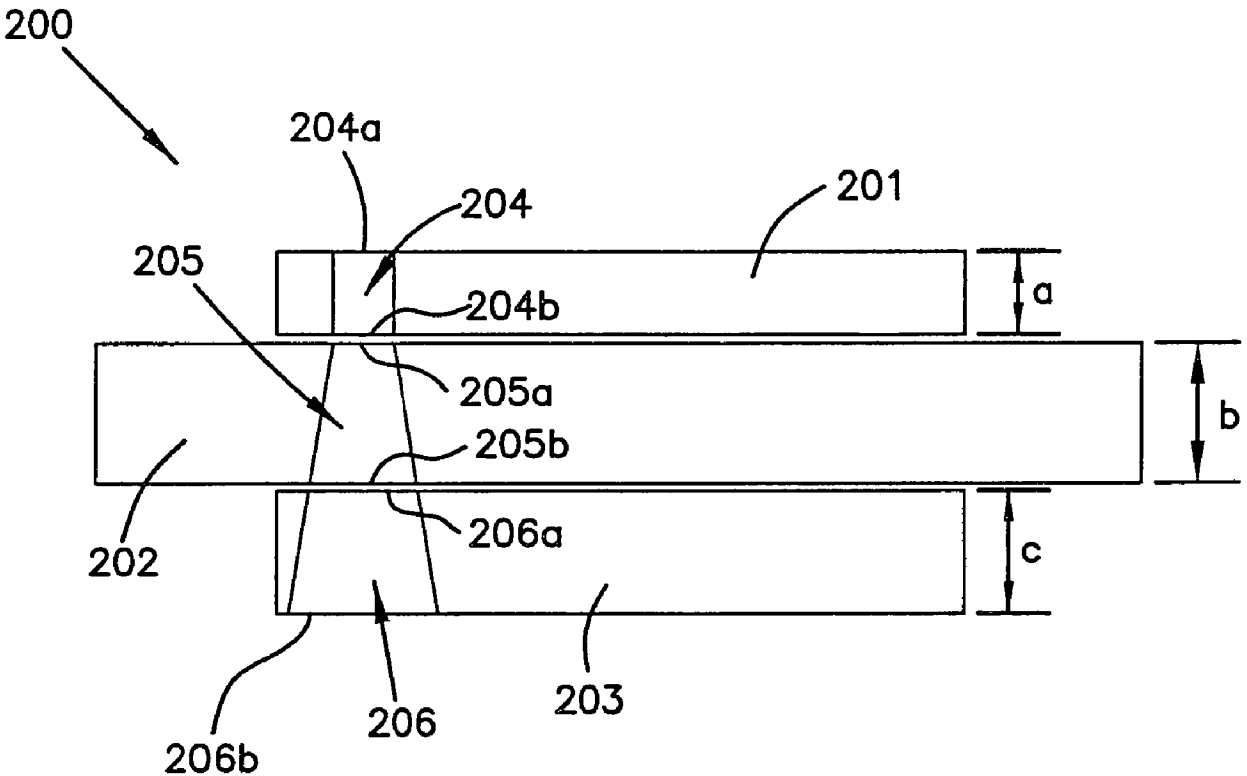
FIG. 13 is a schematic drawing of disk members having dispensing apertures in another embodiment tablet dispenser constructed according to the principles of the present invention.

FIG. 13 shows a schematic drawing of three disk members having dispensing apertures of another embodiment tablet dispenser 200. The first disk member 201 preferably has a thickness a between ⅜ and ½ inch, and the second disk member 202 and the third disk member 203 preferably each have a thickness larger than the thickness of the first disk member 201. Preferably, the thickness b of the second disk member 202 and the thickness c of the third disk member 203 are between ¾ and ⅞ inch.

In addition, the first disk member 201 includes a first dispensing aperture 204, the second disk member 202 includes a second dispensing aperture 205, and the third disk member includes a third dispensing aperture 206. Preferably, the first dispensing aperture 204 has a diameter configured and arranged to contain a predetermined quantity of product tablets thereby assisting in dispensing the desired dose of product. The second dispensing aperture 205 has a diameter larger than the diameter of the first dispensing aperture 204, and the third dispensing aperture 206 has a diameter larger than the diameter of the second dispensing aperture 205.

Most preferably, the dispensing apertures are tapered with a smaller diameter top and a larger diameter bottom, the adjacent tops and bottoms being approximately the same diameter. This ensures that there is more room for the product tablets proximate the bottom of each disk member, which assists in preventing jamming of the product tablets and assists in dispensing of the product tablets. The first dispensing aperture 204 of the first disk member 201 may or may not be tapered.

For product tablets having a diameter of approximately ⅜ inch, the dispensing aperture 204 preferably has a top diameter 204*a* and a bottom diameter 204*b* of slightly greater than ⅜ inch, preferably approximately 0.438 inch. The dispensing aperture 205 preferably has a top diameter 205*a* of approximately the same as the diameters 204*a* and 204*b* and a bottom diameter 205*b* of approximately 0.503 inch. The dispensing aperture 206 preferably has a top diameter 206*a* of approximately the same as the diameter 205*b* and a bottom diameter 206*b* of approximately 0.566 inch. The preferred diameters may be +/−0.020 inch.

As the product tablets are dispensed from the first disk member 201, to the second disk member 202, and to the third disk member 203, the thickness of the second disk member 202 and the third disk member 203 are larger than the thickness of the first disk member 201 and the diameters of the dispensing apertures increase. Therefore, the volumes of the dispensing apertures increase, which assists in reducing the occurrence of the product tablets jamming in the tablet dispenser 200. If the dispensing apertures are tapered, this further reduces the occurrence of the product tablets jamming in the table dispenser 200.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A proof of delivery system for use with a solid product dispenser, comprising:

a) an outlet conduit being light transmissive and including an interior surface and an exterior surface, the interior surface being exposed to humid conditions;

b) a sensor mechanism proximate the exterior surface of the outlet conduit, the sensor mechanism sensing delivery of a solid product through the outlet conduit c) a mounting surface; and d) a seal interconnecting the outlet conduit and the mounting surface, the seal providing a barrier to the humid conditions thereby preventing the humid conditions from escaping the interior surface to the exterior surface of the outlet conduit proximate the seal and protecting the sensor mechanism from exposure to the humid conditions.

2. The proof of delivery system of claim 1, further comprising a product tablet, wherein the product tablet and the humid conditions create a residue within the outlet conduit, the outlet conduit protecting the sensor mechanism from contamination by the residue.

3. The proof of delivery system of claim 2, wherein the residue is selected from the group consisting of condensation, portions of the product tablet, and residual product.

4. The proof of delivery system of claim 1, wherein the sensor mechanism includes an emitter emitting a beam and a receiver receiving the beam, the emitter being positioned on one side of the outlet conduit and the receiver being positioned on an opposite side of the outlet conduit, the emitter emitting the beam and the receiver receiving the beam through the outlet conduit.

5. The proof of delivery system of claim 1, wherein the mounting surface is a dishwashing machine and the outlet conduit is operatively connected to the dishwashing machine.

6. The proof of delivery system of claim 5, wherein a sanitizing agent is dispensed through the outlet conduit into the dishwashing machine.

7. A proof of delivery system for use with a solid product dispenser, comprising:

a) an outlet conduit being light transmissive and including an interior surface and an exterior surface, the interior surface being exposed to humid conditions;

b) a light sensor mechanism including an emitter emitting a beam and a receiver receiving the beam, the emitter being positioned on one side of the outlet conduit and the receiver being positioned on an opposite side of the outlet conduit, the emitter emitting the beam and the receiver receiving the beam through the outlet conduit, the outlet conduit protecting the light sensor mechanism from contamination by residue within the outlet conduit c) a mounting surface; and d) a seal interconnecting the outlet conduit and the mounting surface, the seal providing a barrier to the humid conditions thereby preventing the humid conditions from escaping the interior surface to the exterior surface of the outlet conduit proximate the seal and protecting the light sensor mechanism from exposure to the humid conditions.

8. The proof of delivery system of claim 7, wherein the residue is selected from the group consisting of condensation, portions of a product tablet, and residual product.

9. The proof of delivery system of claim 7, further comprising an inner surface and an outer surface of the outlet conduit, the inner surface being exposed to humid conditions, the outlet conduit providing a barrier to the humid conditions for the light sensor mechanism.

10. The proof of delivery system of claim 7, wherein the mounting surface is a dishwashing machine and the outlet conduit is operatively connected to the dishwashing machine.

11. The proof of delivery system of claim 10, wherein a sanitizing agent is dispensed through the outlet conduit into the dishwashing machine.

12. The proof of delivery system of claim 7, further comprising a housing through which the outlet conduit is positioned and to which the light sensor mechanism is mounted proximate the outlet conduit.

13. The proof of delivery system of claim 12, wherein the housing is mounted to a dishwashing machine thereby operatively connecting the outlet conduit to the dishwashing machine.

14. The proof of deliver system of claim 7, wherein the light sensor mechanism is an infrared sensor mechanism.

15. A proof of delivery system for use with a solid product tablet dispenser, comprising:

a) a product tablet;

b) an outlet conduit through which the product tablet is dispensed, the outlet conduit being light transmissive and including an interior surface and an exterior surface, the interior surface being exposed to humid conditions;

c) an infrared sensor mechanism including an emitter emitting a beam and a receiver receiving the beam, the emitter being positioned on one side of the outlet conduit and the receiver being positioned on an opposite side of the outlet conduit, the emitter emitting the beam and the receiver receiving the beam through the outlet conduit, the outlet conduit protecting the infrared sensor mechanism from contamination by residue within the outlet conduit, wherein as the product tablet is dispensed through the outlet conduit, the product tablet interrupts the beam within the outlet conduit, and the infrared sensor mechanism provides indication that the product tablet has been dispensed d) a mounting surface; and e) a seal interconnecting the outlet conduit and the mounting surface, the seal providing a barrier to the humid conditions thereby preventing the humid conditions from escaping the interior surface to the exterior surface of the outlet conduit proximate the seal and protecting the infrared sensor mechanism from exposure to the humid conditions.

16. The proof of delivery system of claim 15, wherein the residue is selected from the group consisting of condensation, portions of the product tablet, and residual product.

17. The proof of delivery system of claim 15, further comprising an inner surface and an outer surface of the outlet conduit, the inner surface being exposed to humid conditions, the outlet conduit providing a barrier to the humid conditions for the infrared sensor mechanism.

18. The proof of delivery system of claim 15, wherein the mounting surface is a dishwashing machine and the outlet conduit is operatively connected to the dishwashing machine.

19. The proof of delivery system of claim 18, wherein the product tablet is a sanitizing agent.

20. The proof of delivery system of claim 15, further comprising a housing through which the outlet conduit is positioned and to which the infrared sensor mechanism is mounted proximate the outlet conduit.

21. The proof of delivery system of claim 20, wherein the housing is mounted to a dishwashing machine thereby operatively connecting the outlet conduit to the dishwashing machine.

* * * * *